US007040503B2

(12) United States Patent
Leichter et al.

(10) Patent No.: US 7,040,503 B2
(45) Date of Patent: May 9, 2006

(54) DISPENSER

(75) Inventors: Richard A. Leichter, 48 Grand Tour, Highlands, NJ (US) 07732; William S. Blake, Linwood, NJ (US)

(73) Assignee: Richard A. Leichter, Highlands, NJ (US)

( * ) Notice: Subject to any disclaimer, the term of this patent is extended or adjusted under 35 U.S.C. 154(b) by 222 days.

(21) Appl. No.: 10/696,763

(22) Filed: Oct. 29, 2003

(65) Prior Publication Data

US 2005/0092766 A1 May 5, 2005

(51) Int. Cl.
*B65H 5/28* (2006.01)

(52) U.S. Cl. ..... 221/73; 221/71; 221/25

(58) Field of Classification Search ..... 221/25, 221/71, 73; 226/127, 129, 115
See application file for complete search history.

(56) References Cited

U.S. PATENT DOCUMENTS 5,119,696 A * 6/1992 Yamaguchi ..... 477/109
5,566,829 A * 10/1996 Cotilletta ..... 206/581
6,755,321 B1 * 6/2004 Solovay et al. ..... 221/73

* cited by examiner

*Primary Examiner*—Donald P. Walsh
*Assistant Examiner*—Kaitlin Joerger
(74) *Attorney, Agent, or Firm*—Robert M. Skolnik

(57) ABSTRACT

A manually operated dispenser for medicated or non-medicated orally dissolving strips provided in roll form cuts portions of the roll to a predetermined size in the manner of the strips currently available in single sheets and housed in the vial shown in patent Des. 423,302. The dispenser includes spring-loaded structure rotating the roll and presenting material of a predetermined strip length to a cutting blade, then slicing the strip from the roll.

15 Claims, 6 Drawing Sheets

DISPENSER

CROSS REFERENCE TO RELATED APPLICATIONS

None.

BACKGROUND OF THE INVENTION

1. Field of the Invention

The present invention relates to a manually operated dispenser for medicated or non-medicated orally dissolving strips provided in roll form. The dispenser cuts portions of the roll to a predetermined size in the manner of the strips currently available in single sheets and housed in the vial shown in patent Des. 423,302. The dispenser includes spring-loaded structure rotating the roll and presenting material of a predetermined strip length to a cutting blade, then slicing the strip from the roll.

2. Description of the Related Art

Haner, et al. Des. 423,302 is the vial housing the strips currently on the market.

Wise, Re. 22,827, is one of many patents showing a stripping finger used to contact a rotatable cylinder to remove paper from the cylinder.

Carriero, U.S. Pat. No. 3,598,395, automatically feeds cards from a stack of cards by the use of detents 12–15.

Van Der Does, U.S. Pat. No. 3,627,307, dispenses film from a stack one sheet at a time by clipping the top sheet of the stack after the top sheet is raised by pinching the stack.

Stephens, et al, U.S. Pat. No. 4,269,403 show a feed roller with a plurality of fingers thereon. Pressure by the fingers on the stack is variable.

Wade, et al., U.S. Pat. No. 5,881,350 represents a number of structures using two feed rollers one on the top and the other on the bottom of a stack.

Simpson, U.S. Pat. No. 6,550,636 dispenses single sheet from a spring-loaded structure having no moving parts.

SUMMARY OF THE INVENTION

This invention relates to a dispenser for the orally dissolving strips currently marketed under the trademark POCKETPAKS, for example. The strips, which may be medicated or non-medicated, are packaged and sold in a vial shown in DES. 423,302. The strips rapidly dissolve in the mouth thereby acting as an oral delivery system for drugs, breath freshener, etc. The present invention uses a roll of such strip material and cuts portions of the roll to a desired length. The roll is formed of the strip material plus a base layer serving as a carrier and as a separator. The base layer/separator has at least one apertured edge formed thereon for engaging an advancing mechanism, and delivering a portion of the strip material to a separating and cutting location. The base layer minimizes the adverse effects of temperature and humidity on the strip material by preventing portions of the strip material from contacting other portions of the strip material. For example, the aforesaid POCKETPAKS vial is marked for storage between 59° F.–77° F. and to avoid humidity. Temperature and humidity cause the strip material to become too brittle or too soft or permits them to stick together.

A principal object of the invention is to provide a dispenser for a roll of medicinal strip material. Another object of the invention is the provision of a dispenser, which separates the medicinal material from a carrier/separator and cutting the medicinal material to a desired length. A further object is the provision of dispenser of the class described having a base and a spring-loaded removable cover forming a storage space for a roll of medicinal material. A still further object and advantage of the invention is the incorporation of a cutting blade on the spring-loaded cover for cutting the medicinal material to a desired length. Another object and advantage of the invention is the provision of a rack and pinion structure for advancing a portion of the medicinal material from the roll to a carrier separating and cutting station. Another object of the invention is the provision of a dispenser where the roll of material is mounted within a carrier.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENT

Figure 1:
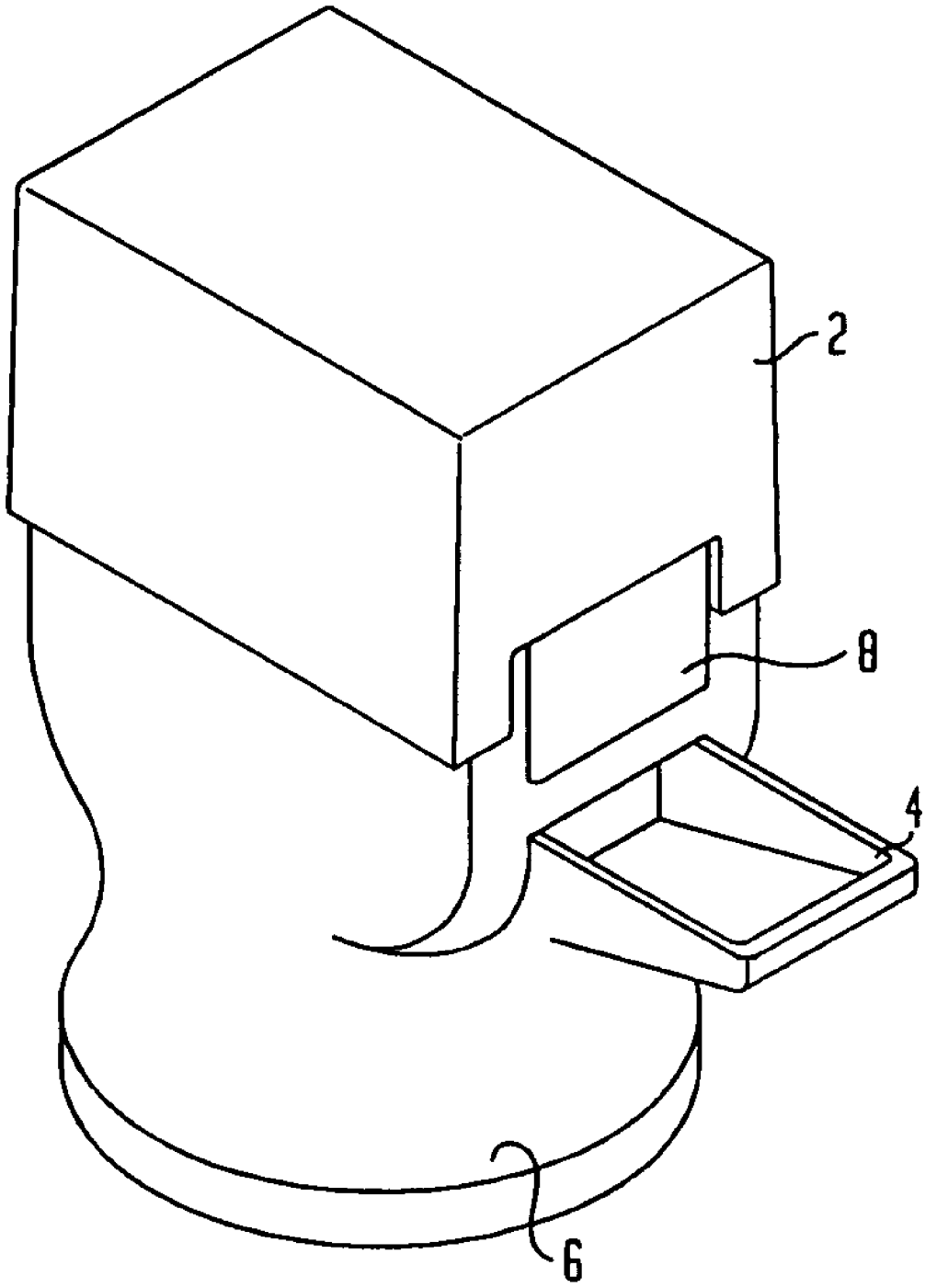
FIG. 1 is a perspective view of the preferred embodiment of our invention.
Figure 2:
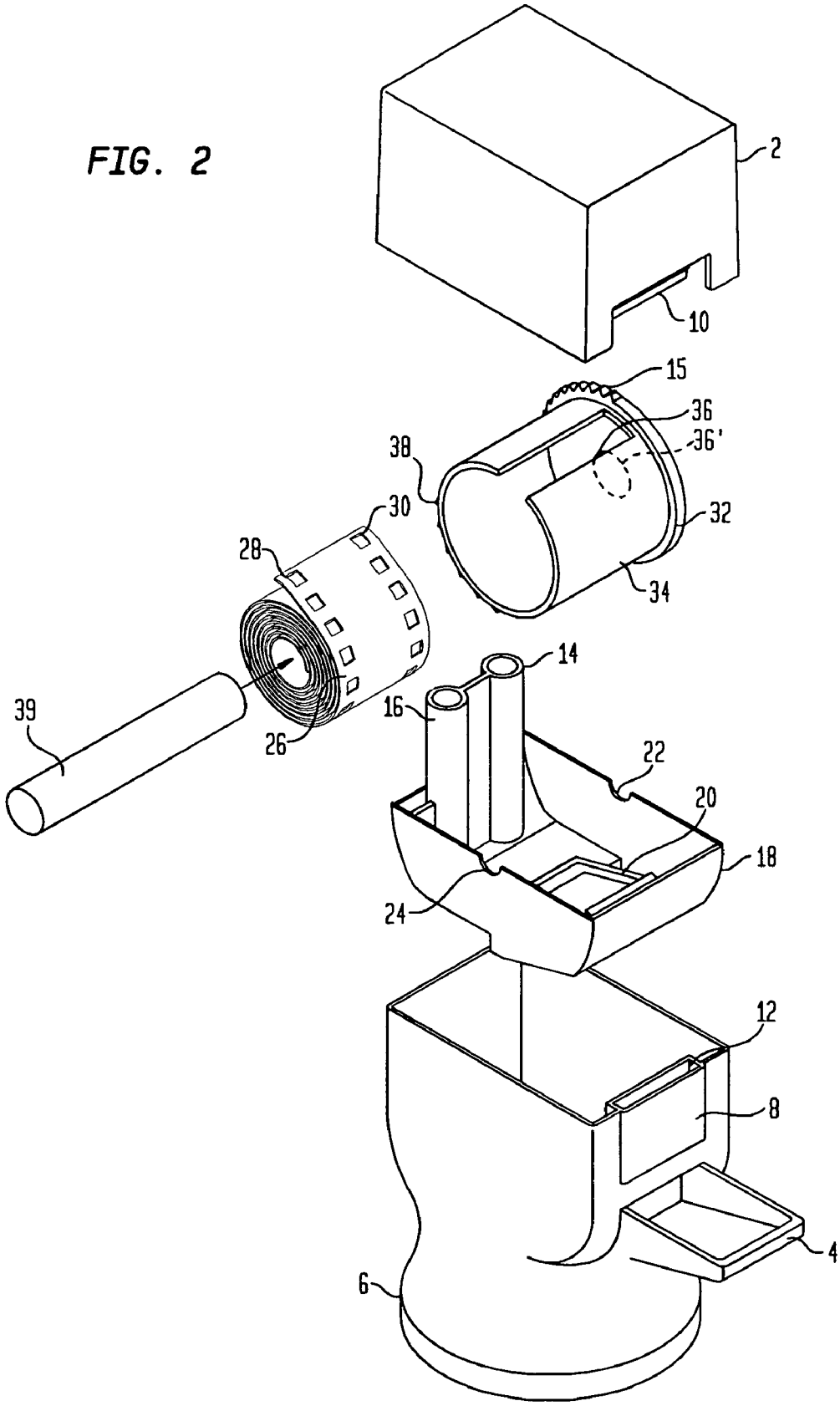
FIG. 2 is an exploded view of the preferred embodiment of our invention.

Like reference numerals have been used to designate like parts in FIGS. 1–5A and 5B. FIG. 1 is a perspective view of the dispenser of our invention. A circular base portion 6 has a tray 4 formed therein. The tray 4 is positioned beneath a cutting housing 8. A spring loaded manually depressed top portion 2 is attached to the base 6. FIG. 2, is an exploded view of the dispenser of FIG. 1. A roll 26 of medicinal strip material is formed by carrier 17 which has notches 28 and 30 formed along both edges and orally dissolving strip material 25 peelably affixed to the carrier. Roll 26 is inserted into circular roll support 34. The support 34 has a feed slot 36 formed therein for receiving a portion of the roll 26 and permitting the portion to extend along the surface of the support 34 so that teeth 38 formed on the surface of support 34 thereon can engage notches 28 and 30. The support 34 has an enlarged end cap portion 32, which has gear teeth 15 formed along a portion of the surface thereof. A cutting blade 10 is affixed to top portion 2. This cutting blade is guided within the aperture 12 in the pocket housing 8 both formed in the circular base 6. The support 34 and the roll 26 mounted therein are in turn supported in a housing 18. The housing 18 has an inclined floating keeper arm 20 formed interiorly thereof for maintaining tension on the roll 26 while a portion of the roll 26 is conveyed to the cutting blade housing 8. Circular spring supports 14 and 16 are also formed in housing 18. Notches 22, 24 are formed in the sidewalls of the housing 18 to support roller rod 39 on the housing 18. Roller rod 39 is inserted into the hollow center of the roll 26 through hole 36' in the end cap 32 of roller support 34. The notches 22, 24 and the diameter of the roller rod 39 are dimensioned such that the roll 26 will always ride in the aperture formed in inclined keeper arm 20. As the diameter of roll 26 decreases by use of the material, the rod drops down in the notches 22, 24.

Figure 3:
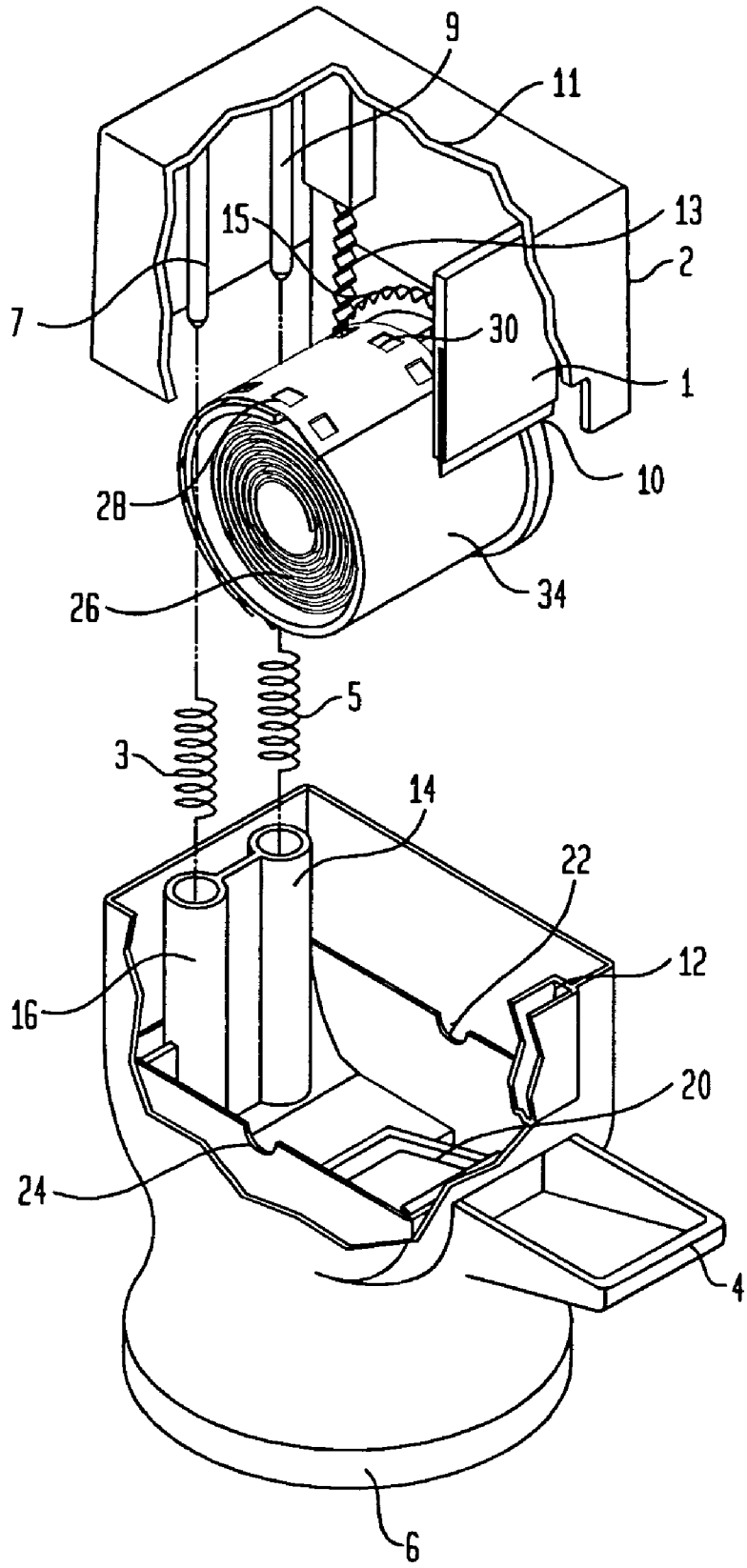
FIG. 3 is an exploded view of the preferred embodiment of our invention, partially assembled.

FIG. 3 is an exploded view of the apparatus of FIG. 2 showing more detail. In FIG. 3, a portion of the roll 26 is shown extending onto the surface of the support 34 with notches 28 engaging teeth 38 (not shown). Springs 3 and 5 are mounted in spring supports 16 and 14, respectively. These springs fit onto rods 7 and 9 formed in the top portion 2. As will now be seen, gear teeth 15 are part of a rack and pinion arrangement with gear 13 removeably attached to support portion 11 formed in top 2. Further detail of the mounting of cutting blade 10 can also be seen in FIG. 3. The blade 10 is fit into a blade support pocket 1. The blade support is a compression fitting removeably supporting the blade 10 in a pocket formed between the two walls of blade support 1.

Figure 4:
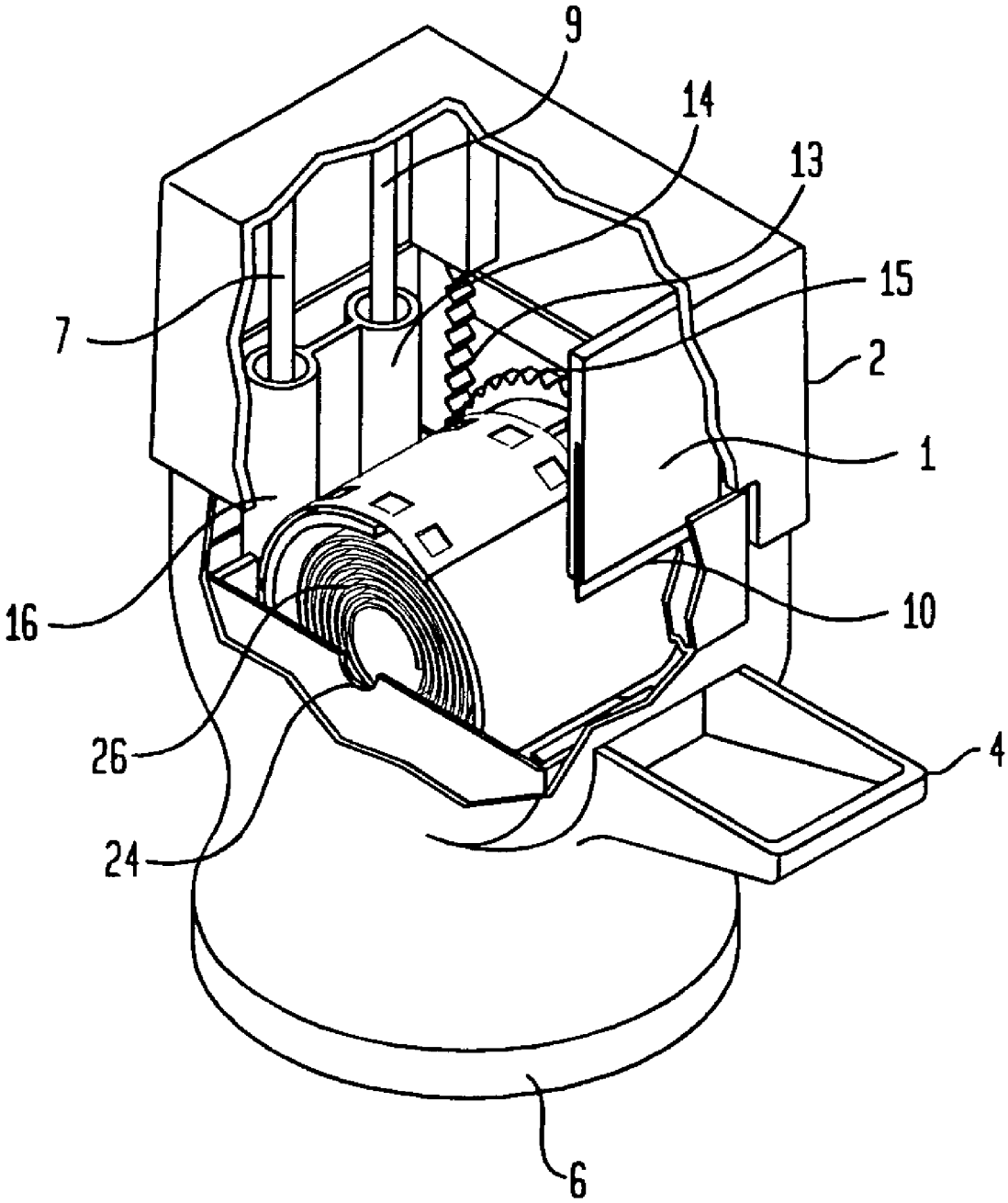
FIG. 4, is a sectional view of the preferred embodiment of our invention.

FIG. 4 shows the parts of FIG. 3 assembled in its resting position.

Figure 5A:
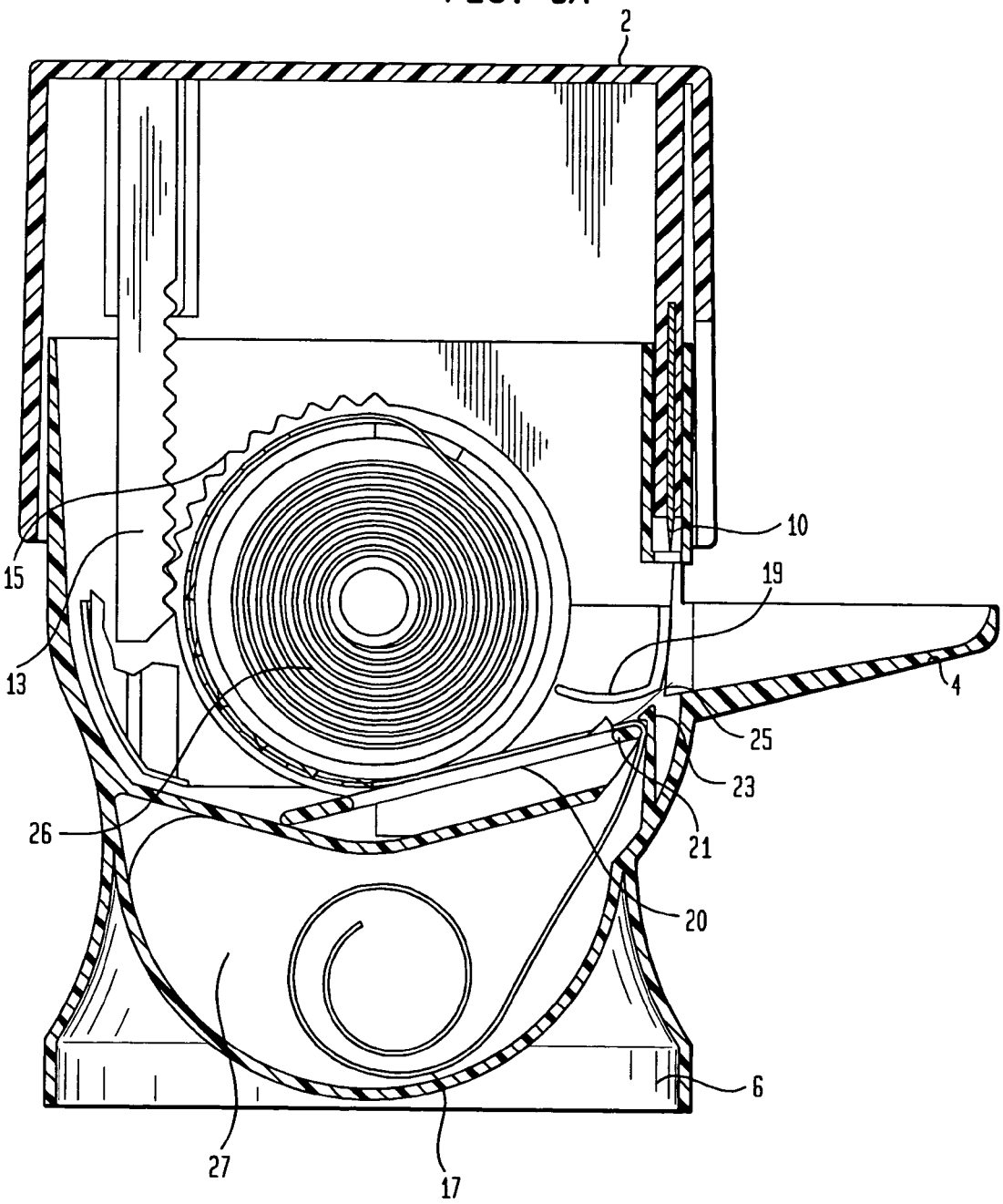
FIGS. 5A–5B, are sectional views of the preferred embodiment of our invention, in a first and a second position.
Figure 5B:
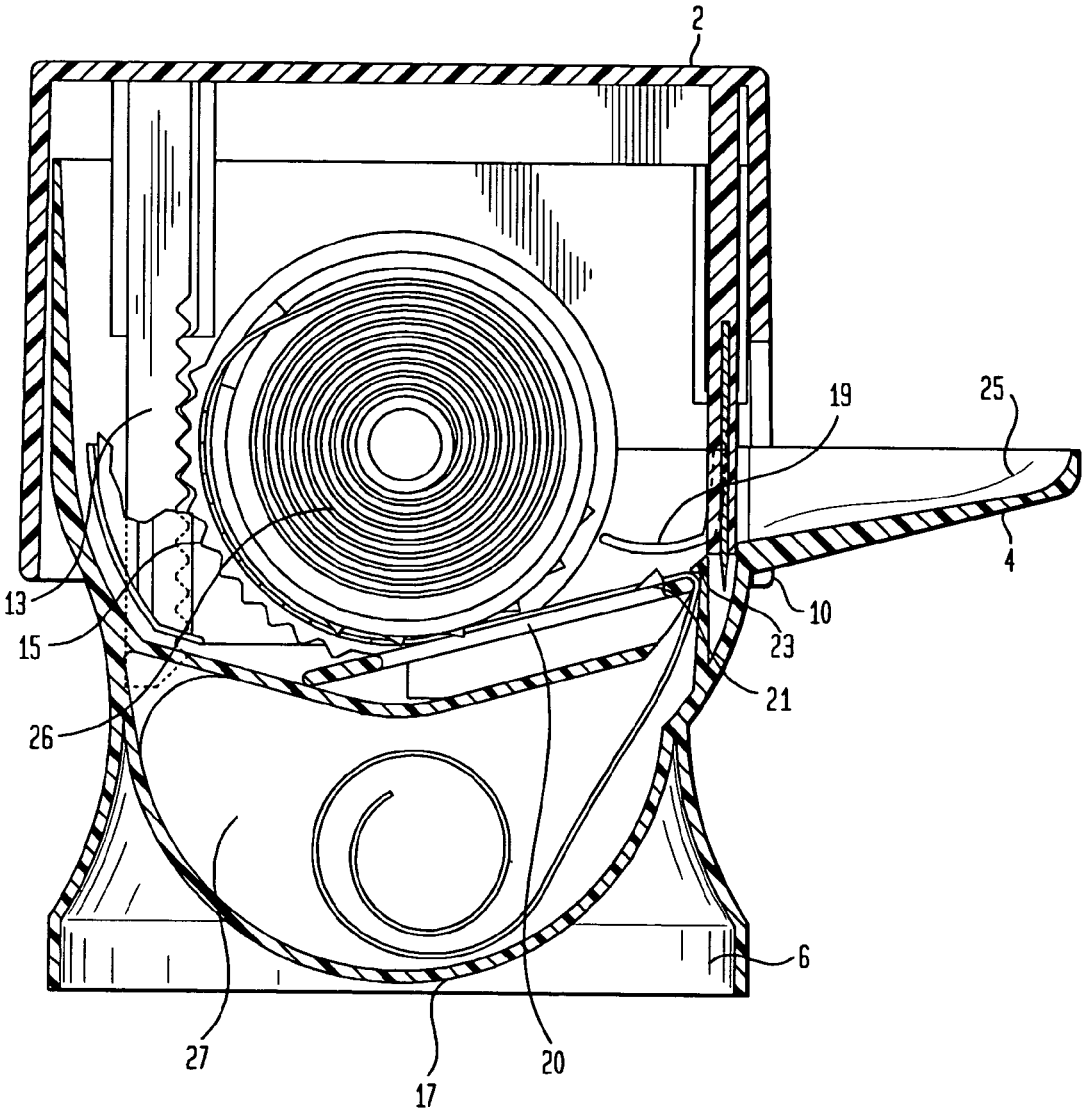

FIGS. 5A–5B are sectional views of the apparatus of FIG. 4 with FIG. 5B showing the top 2 fully depressed. When top 2 is depressed, the rack and pinion gear assembly 13, 15 causes support 34 to rotate a predetermined distance thereby causing a length of material from roll 26 to be fed to a location where its carrier portion 17 and medicinal material portion 25 are separated, then the material 25 is cut. Separation is accomplished by peeling the carrier 17 from the medicinal portion 25. The peeling occurs via the finger hook 23 guiding the tounged portion of carrier 17 downwardly while film portion 25 is guided via shield 19 into trough 4. The teeth 21 hold the carrier preventing it from rolling back when the top portion is returned to its uppermost position. The surface 19 causes the material 25 to be directed into hopper 4 while carrier 17 is directed downwardly into the hollow storage area 27 in the circular base 6. The medicinal material portion 25 is not so captured but is peeled off the carrier by the hook 23 onto the hopper 4 for cutting by blade 10.

In order for the strip portion 25 is dispensed into the hopper 4, it must be separated from the carrier 17. In order to start the required peeling action, the roll is formed with an extension or tongue at its leading edge that is manually fed into the hopper 27 until the edge of the strip portion reaches the hook separator 23. Separation or peeling will then be effected by the roll advance motion created by the rack and pinion mechanism. Teeth 21 cooperate with keeper arm 20 to form a floating keeper arrangement to insure that the roll does not retract with support drum 34 when the drum returns to set up for the next cutting cycle of metered advancement. This floating keeper maintains tension on the roll 26 because a portion of the roll rides on the arm and is held by teeth 21.

Further modifications to the apparatus of the invention may be made without departing from the spirit and scope of the invention; accordingly, what is sought to be protected is set forth in the appended claims.

What is claimed is:

1. A dispenser comprising a roll of a film of orally dissolving material peelably affixed to a support surface; at least one set of notches formed on an edge of said support surface; a cylindrical support for receiving said roll therein, a slot formed on said cylindrical support for permitting a portion of said roll to protrude therefrom, a first plurality of teeth formed on said cylindrical support surface for engaging said notches; a second plurality of teeth formed on said cylindrical support surface forming a pinion gear; rack gear means cooperating with said pinion gear for rotating said cylindrical support; keeper arm means for continuously maintaining tension on said roll; at least two teeth mounted on said keeper arm means for limiting directional movement of a portion of said support surface; peeling means formed adjacent said keeper arm means for peelably removing said film from said support surface; film cutting means formed adjacent to said peeling means for cutting a portion of said film to a predetermined size; and hopper means formed adjacent to said film cutting means for receiving said film portion.

2. A dispenser for rolled material comprising: a housing having a top portion and a bottom portion, spring means connected between said top portion and said bottom portion for permitting said top portion to be manually depressed onto said bottom portion; a cylindrical carrier for rolled material mounted in said bottom portion; rack and pinion gear means for rotating said cylindrical carrier when said top portion is manually depressed; said rack and pinion gear mans including gear teeth formed on said cylindrical carrier and rack means engaging said gear connected to said top portion; and cutting means mounted in said top portion for cutting dispensed rolled material when said top portion is depressed onto said bottom portion.

3. The dispenser of claim 2 further including hopper means formed on said bottom portion adjacent said cutting means for receiving the cut rolled material.

4. The dispenser of claim 3 further including a material storage chamber formed in said bottom portion.

5. The dispenser of claim 4 further including a roll of material to be dispensed mounted on said cylindrical carrier, said roll having two layers, a first layer having at least one row of notches formed at one edge thereof and a second layer mounted on said first layer; a plurality of teeth mounted on said cylindrical carrier for engaging said notches and advancing said material when said top portion is depressed onto said bottom portion.

6. The dispenser of claim 5 further including separating means mounted in said bottom portion adjacent said cutting means for separating said first layer from said second layer and directing said first layer into said material storage chamber and said second layer into said hopper.

7. The dispenser of claim 5 further including means for preventing said roll from turning in a second direction including floating keeper arm means mounted in said bottom portion for continuously maintaining tension on said roll and means mounted on said floating keeper arm means for engaging said notches.

8. A dispenser for rolled material comprising: a housing having an upper portion and an lower portion, said upper portion being movable onto said lower portion; spring means connected to said upper portion and said lower portion for maintaining said portions in a first position; cutting means mounted in said upper portion for cutting a portion of said rolled material; a rotatable cylindrical support for rolled material mounted in said lower portion; gear means connected to said upper portion and said rotatable cylindrical support for rotating said cylindrical support and cutting a portion of said rolled material when said upper portion is moved onto said lower portion; and means mounted in said lower portion for limiting bi-directional movement of said rolled material.

9. The dispenser of claim 8 wherein said bi-directional movement limiting means includes means for continuously maintaining tension on said rolled material.

10. The dispenser of claim 9 wherein said bi-directional movement limiting means includes teeth for engaging said rolled material.

11. The dispenser of claim 10 wherein said gear means includes a rack connected to said upper portion and a pinion formed on said cylindrical support.

12. The dispenser of claim 11 further including separating means formed in said lower portion adjacent said cutting means for separating said rolled material into two parts and providing one of said parts to said cutting means.

13. The dispenser of claim 12 further including a storage chamber formed in said lower portion for receiving and storing the other of said parts of said rolled material.

14. The dispenser of claim 13 further including a roll of material to be dispensed, said roll being formed of a carrier part and a film part, said film part peelably engaging said carrier part.

15. The dispenser of claim 14 wherein said carrier part includes a plurality of notches for engaging said teeth.

* * * * *